United States Patent [19]

Howard

[11] 4,381,958

[45] May 3, 1983

[54] TRIAMINOGUANIDINE NITRATE-CONTAINING PROPELLANTS

[75] Inventor: William M. Howard, Fort Walton Beach, Fla.

[73] Assignee: Hercules Incorporated, Wilmington, Del.

[21] Appl. No.: 176,211

[22] Filed: Aug. 7, 1980

[51] Int. Cl.[3] ..... C06B 45/00

[52] U.S. Cl. ..... 149/19.8; 149/92

[58] Field of Search ..... 149/19.8, 19.4, 19.91, 149/92

[56] References Cited

U.S. PATENT DOCUMENTS

| | | | |
|---|---|---|---|
| 2,929,699 | 3/1960 | Audrieth et al. | 52/5 |
| 3,285,958 | 11/1966 | Satrianna | 260/564 |
| 3,732,130 | 5/1973 | Flanagan et al. | 149/18 |
| 3,732,131 | 5/1973 | Haury et al. | 149/18 |
| 3,813,439 | 5/1974 | Picard et al. | 260/564 F |
| 3,954,528 | 5/1976 | Chang et al. | 149/19.4 |
| 4,029,529 | 6/1977 | Elrick et al. | 149/19.8 |
| 4,092,188 | 5/1978 | Cohen et al. | 149/19.4 |
| 4,216,039 | 8/1980 | Pierce | 149/19.8 |
| 4,239,561 | 12/1980 | Camp et al. | 149/19.8 |
| 4,299,636 | 11/1981 | Hartman et al. | 149/19.8 |

FOREIGN PATENT DOCUMENTS 1518197 9/1969 Fed. Rep. of Germany .

OTHER PUBLICATIONS

Explosivstoffe 12 (9), 197–9, (1964).
J. Org. Chem. 32, 285–9, (1967).

*Primary Examiner*—Edward A. Miller
*Attorney, Agent, or Firm*—Hazel L. Deming

[57] ABSTRACT

The thermal stability of propellant compositions containing triaminoguanidine nitrate and an energetic plasticizer-binder system is vastly improved by including in the composition an amount of resorcinol sufficient to provide with the plasticizer a solution which is essentially saturated or super-saturated at 25° C.

10 Claims, No Drawings

TRIAMINOGUANIDINE NITRATE-CONTAINING PROPELLANTS

The Government has rights in this invention pursuant to Contract No. FO8635-77-C-0166 awarded by the Department of the Air Force.

This invention relates to improved propellant compositions containing triaminoguanidine nitrate and more particularly to gas generating and rocket and gun propellant compositions containing triaminoguanidine nitrate and an energetic plasticizer-binder system which includes a thermal stabilizer.

Solid gun propellant compositions comprised of nitrocellulose, an energetic plasticizer and triaminoguanidine nitrate (TAGN) are taught by Haury et al in U.S. Pat. No. 3,732,131 to provide a high mass impetus at relatively low flame temperatures with a minimum evolution of corrosive combustion products. The compositions also contain a small amount of a conventional stabilizer to improve the thermal stability of the propellant and provide acceptable resistance to chemical deterioration during normal ambient storage. The most commonly employed thermal stabilizers for solid propellants are diphenylamine, 2-nitrodiphenylamine, ethyl centralite (N,N'-diethylcarbanilide), N-methyl-p-nitroaniline and resorcinol, and usually a combination of ethyl centralite and resorcinol, in an amount to provide from 0.5 to 1.5 weight % stabilizer based on the propellant. Although the thermal stability of propellants containing TAGN, a nitroplasticized-nitrocellulose binder system and the above stabilizers is improved over propellants which do not contain the stabilizer, additional improvement is not only highly desirable, but in some cases necessary to assure reliability and reproducibility of mechanical properties under more flexible storage conditions such as those encountered in abnormal heat spells and/or when unexpectedly long storage times are involved and to maximize safety precautions by forestalling autocatalytic decomposition and any possibility for self-ignition.

Now, in accordance with this invention, it has been found that the thermal stability of gun and rocket propellant compositions containing TAGN and an energetic plasticizer-binder system can be vastly improved by including in the composition an amount of resorcinol sufficient to provide with the plasticizer a solution which is essentially saturated or super-saturated with resorcinol at 25° C. This finding was completely unexpected since the amount of resorcinol which provides the improved propellant compositions in accordance with this invention not only far exceeds the amount necessary to scavenge the reactive decomposition products produced solely from the temperature-dependent unimolecular decomposition of the plasticizer or combinations of the plasticizer and binder or combinations of TAGN and the binder, but also substantially exceeds that amount of stabilizer which in the past has been deemed to be the maximum amount tolerable in gun propellants without attendant destabilization of the propellant.

The improved propellant compositions of this invention are formulated using triaminoguanidine nitrate (TAGN) as the solid oxidizer and a liquid plasticizer-binder system which contains the resorcinol stabilizer. TAGN is a dense, nonhydroscopic, thermally stable, crystalline solid which can be readily prepared from guanidine nitrate and hydrazine, from calcium cyanamide and hydrazine nitrate or from dicyandiamide and a mixture of hydrazine nitrate and hydrazine hydrate. The latter process is particularly convenient and is described, for example, by Satriana in U.S. Pat. No. 3,285,958. Thus, by reacting 0.2 mole of dicyandiamide, 0.25 mole of hydrazine nitrate and 0.8 mole of hydrazine hydrate at 85°–90° C. for about 3.5 hours, adding about 6 moles of water to the hot reaction product, heating to form a solution and then quickly chilling the solution to precipitate a crystalline product from solution, high yields of TAGN crystals can be obtained. TAGN crystals recovered in this manner can be used as such. However, in accordance with this invention, it has further been found that if the TAGN crystals are slowly recrystallized from aqueous solutions in a certain manner, additional improvement in propellant stability can be realized. The manner in which TAGN is recrystallized has been found to have an important bearing on the realization of these additional benefits and it has been found particularly advantageous to carry out the recrystallization by dissolving TAGN crystals in distilled water in a metal-free environment at a temperature of 20° to 30° C., cooling the aqueous solution to a temperature below its saturation temperature and maintaining the temperature at below the saturation temperature until crystals of TAGN are slowly precipitated therefrom.

As stated, the propellant compositions of this invention are TAGN-containing propellants. TAGN can be used alone or as a mixture of TAGN with up to about 75% by weight of the mixture of one or more secondary oxidizers such as cyclotrimethylene trinitramine, cyclotetramethylene tetranitramine, pentaerythritol tetranitrate, dipentaerythritol hexanitrate, ethylene dinitramine, and the like. Generally, TAGN or the TAGN mixture will comprise from 20 to 85 and preferably from 30 to 80 weight % of the propellant composition and the remainder of the composition will comprise the plasticizer, binder and resorcinol. The binder content of the composition can vary from 5 to 70 and preferably from 10 to 60% by weight of the composition and the amount of plasticizer (including the resorcinol dissolved therein) will range from about 10 to 75 and preferably from 10 to 60% by weight of the propellant composition.

The plasticizer can be any of the known liquid energetic plasticizers for the binder component such as the nitrate-esters and/or organic nitramines. Particularly useful are nitroglycerine, trimethylolethane trinitrate, diethylene glycol dinitrate, triethylene glycol dinitrate, butanetriol trinitrate, and the 1-(N-alkylnitramino)-2-nitroxyethanes, 1-(N-ethylnitramino)-2-nitroxyethane, 1-(N-propylnitramino)-2-nitroxyethane, 1-(N-butylnitramino)-2-nitroxyethane, 1-(N-pentylnitramino)-2-nitroxyethane, 1-nitropiperidine, and the like, as well as blends of any of the above, with or without non-energetic plasticizers such as diethyl phthalate, dibutyl phthalate, dioctyl sebacate, the polyalkylene glycols and particularly polyethylene glycol or polypropylene glycol and the alkyl ether derivatives of the polyalkylene glycols.

The binder material can be of the so-called active type such as nitrocellulose or can be an inert polymer such as ethyl cellulose, cellulose acetate, ethyl cellulose based polyurethanes, polyester based polyurethanes such as polyglycol adipate, polyether based polyurethanes such as polyoxypropylene diol, and butadiene based polyurethanes such as hydroxyl-terminated and carboxyl-terminated polybutadienes. Nitrocellulose-containing binders and particularly binders containing nitrocellulose having a nitrogen content from about 12 to 13.5% are preferred.

As stated above, the propellant compositions of this invention contain resorcinol in a quantity sufficient to provide with the plasticizer a solution or mixture which is essentially saturated or super-saturated at 25° C. By the phrase "essentially saturated" as used herein is meant a solution which contains at least 80% of the maximum amount of resorcinol which can be dissolved in the plasticizer at 25° C. Thus, the minimum amount of recorcinol necessary to provide the advantages of this invention will vary, depending upon the particular plasticizer employed and its solubility parameter. Generally, it is preferred to use a single plasticizer or plasticizer blend which is saturated or super-saturated with resorcinol at 25° C.

The propellant compositions of this invention do not contain metal fuels but can contain ballistic modifiers such as potassium nitrate, lead stearate, etc., and conventional thermal stabilizers such as 2-nitrodiphenylamine and ethyl centralite. The propellants can be manufactured utilizing conventional solid propellant equipment and propellant granules can be deterrent coated and/or graphite glazed in the manner conventional to gun propellant manufacture.

Table I lists the compositions of five typical propellant formulations along with their calculated performance characteristics.

TABLE I

| Number | 1 | 2 | 3 | 4 | 5 |
|---|---|---|---|---|---|
| Oxidizer[1], wt. % | | | | | |
| TAGN | 60 | 30 | 30 | 70 | 30 |
| HMX | — | 37 | 50 | — | — |
| Binder[2], wt. % | | | | | |
| NC | 15 | 15 | 5 | 15 | 35 |
| EC | — | — | 5 | — | — |
| Plasticizer[3], wt. % | | | | | |
| BNENA | 21 | — | — | — | — |
| ENENA | — | — | — | 12 | 30 |
| PRNENA | — | 15 | 8 | — | — |
| Resorcinol, wt. % | 4 | 3 | 2 | 3 | 5 |
| Oxygen balance, % | −54.7 | −41.9 | −42.6 | −42.3 | −51.7 |
| Heat of explosion, cal./g. | 688 | 948 | 940 | 931 | 762 |
| Flame temperature (constant volume), °K. | 2,125 | 2,902 | 2,885 | 2,695 | 2,386 |
| Mass impetus, ft.-lb./lb. | 330,000 | 395,000 | 398,000 | 397,000 | 339,000 |
| Specific impulse, lb.-sec./lb. | 212 | 236 | 236 | 236 | 217 |
| Combustion gas average molecular weight | 17.9 | 20.4 | 20.2 | 18.9 | 19.6 |

[1]TAGN = triaminoguanidine nitrate HMX = cyclotetramethylene tetranitramine
[2]NC = nitrocellulose (12.6% N) EC = ethyl cellulose
[3]BNENA = 1-(N—butylnitramino)-2-nitroxyethane ENENA = 1-(N—ethylnitramino)-2-nitroxyethane PRNENA = 1-(N—propylnitramino)-2-nitroxyethane The invention is further illustrated by reference to the following examples which demonstrate the best-known embodiments of the invention. In these examples, the propellant compositions were tested for thermal stability at 110° C. by measuring the gassing rate by the Taliani test method and Taliani test apparatus. This apparatus is a constant gas volume system with a glass tube connected to a mercury manometer. The glass tube is heated by an electrically heated metal block. A propellant sample of 1.0 gram is placed in the glass tube, the glass tube is then placed in the heated block and the pressure of the system resulting from the gassing of the propellant is recorded at appropriate time intervals. The data acquired is a measure of the gas evolved during a 300 minute time period or until a pressure of 300 mm Hg is reached, whichever is earlier, and the rate of gas evolution is determined from the slope of a line developed by plotting gas pressure (mm Hg) against time (minutes), and reporting (when possible) the slope at 100 minutes and/or the time to reach 300 mm Hg pressure.

EXAMPLES 1 to 10

Various gun propellant compositions containing triaminoguanidine nitrate oxidizer (TAGN), nitrocellulose binder (NC), plasticizer and resorcinol stabilizer were prepared. The resorcinol was dissolved in the plasticizer and all of the ingredients were thoroughly mixed in a solvent at 25° C. to form a homogeneous dough and the dough was dried. The "recrystallized" TAGN used in Examples 3, 4 and 7 was prepared by dissolving 30 parts of TAGN crystals produced by the process of U.S. Pat. No. 3,285,958 in 750 parts of distilled water in a glass container at room temperature (25° C.), placing the container in a refrigerator at 0° C. for 18 hours, separating the crystals from the remaining solution, quickly washing the crystals with cold (about 0° C.) distilled water, drying the washed crystals at 40° C. under about 40 mm. pressure and then storing the dried crystals in a desiccator over anhydrous calcium sulfate. The gun propellant compositions set forth as Examples 6 to 10 are for comparison purposes and were prepared and tested in the same manner as Examples 1 to 5 except that the amount of resorcinol (or a combination of resorcinol with ethyl centralite or 2-nitrodiphenylamine) used was less than the amount required to provide an essentially saturated solution with the plasticizer at 25° C.

TABLE II

Thermal Stability of Resorcinol Stabilized Gun Propellant Compositions

| Composition, parts by weight | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| TAGN | 9.2 | 50 | 49.5[2] | 50[2] | 50 | 50 | 49.2[2] | 50 | 50 | 50 |
| NC | 4.1 | 2.3 | 19.8 | 2.3 | 20 | 20 | 20 | 19.5 | 19.5 | 19.5 |
| Plasticizer[1] | | | | | | | | | | |
| BNENA | 77.9 | 42.9 | 27.6 | 42.9 | — | — | 29.4 | — | — | — |
| NP | — | — | — | — | 21 | 29 | — | — | — | — |
| PNENA | — | — | — | — | — | — | — | 30 | 30 | 30 |
| Resorcinol | 8.8 | 4.8 | 3.1 | 4.8 | 9 | 1 | 0.76 | 0.5 | 0.25[3] | 0.25[4] |
| Gassing rate, | 1.32 | 1.97 | 1.00 | 0.83 | 1.23 | — | — | — | — | — |

TABLE II-continued

| Composition, parts by weight | Thermal Stability of Resorcinol Stabilized Gun Propellant Compositions | | | | | | | | | |
|---|---|---|---|---|---|---|---|---|---|---|
| | Ex. 1 | Ex. 2 | Ex. 3 | Ex. 4 | Ex. 5 | Ex. 6 | Ex. 7 | Ex. 8 | Ex. 9 | Ex. 10 |
| mm Hg/min. measured at 110° C. and 100 minutes | | | | | | | | | | |
| Time in minutes to reach 300 mm Hg pressure | 195 | 147 | 283 | >300(5) | 210 | 82 | <80(6) | 30 | 15 | 20 |

(1)BNENA = 1-(N—butylnitramino)-2-nitroxyethane NP = 1-nitropiperidine PNENA = 1-(N—pentylnitramino)-2-nitroxyethane
(2)recrystallized
(3)plus 0.25 part ethyl centralite
(4)plus 0.25 part 2-nitrodiphenylamine
(5)stopped at 255 mm Hg (300 minutes)
(6)stopped at 261 mm Hg (75 minutes), extrapolated to 300 mm Hg

I claim:

1. In a solid gas generating, rocket or gun propellant composition comprising an intimate mixture of an oxidizing agent selected from triaminoguanidine nitrate (TAGN) and mixtures of TAGN with secondary organic oxidizing agents, a liquid energetic nitrate ester or organic nitramine plasticizer, a nitrocellulose-containing binder component and a stabilizer, the improvement wherein the stabilizer comprises resorcinol, said resorcinol being employed in the liquid energetic plasticizer in an amount so as to at least essentially saturate the liquid energetic plasticizer with resorcinol at 25° C.

2. The composition of claim 1 in which the TAGN is the crystalline product obtained by dissolving TAGN in distilled water in a metal-free environment at a temperature between 20° C. and 30° C., cooling and maintaining the resulting aqueous solution at a temperature below its saturation temperature until a crystalline precipitate is formed and recovering the crystalline product.

3. The composition of claim 1 in which the plasticizer is a 1-(N-alkylnitramino)-2-nitroxyethane.

4. The composition of claim 3 in which the plasticizer is 1-(N-butylnitramino)-2-nitroxyethane.

5. The composition of claim 1 in which the plasticizer is 1-nitropiperidine.

6. The composition of claim 1 in which the oxidizing agent comprises from about 20% to about 85% by weight of the propellant composition.

7. The composition of claim 6 in which a mixture of TAGN and secondary organic oxidizing agents is employed, the TAGN comprising at least 25% by weight of the mixture.

8. The composition of claim 7 in which the binder component comprises from about 5% to about 70% and the liquid energetic plasticizer including resorcinol dissolved therein comprises about 10% to about 75%, based on the weight of the propellant composition.

9. The composition of claim 2 in which the oxidizing agent is TAGN and TAGN comprises from about 20% to about 85% by weight of the propellant composition.

10. The composition of claim 9 in which the binder component comprises from about 5% to about 70% and the liquid energetic plasticizer including resorcinol dissolved therein comprises about 10% to about 75%, based on the weight of the propellant composition.

* * * * *